US006896306B2

(12) United States Patent
Schierholz

(10) Patent No.: US 6,896,306 B2
(45) Date of Patent: May 24, 2005

(54) ACTUATOR MECHANISM FOR A TWO-BUCKET GRAB DEVICE

(75) Inventor: Manfred Schierholz, Eben (DE)

(73) Assignee: Kinshofer Greiftechnik GmbH, Waakirchen (DE)

( * ) Notice: Subject to any disclaimer, the term of this patent is extended or adjusted under 35 U.S.C. 154(b) by 163 days.

(21) Appl. No.: 10/113,717

(22) Filed: Apr. 1, 2002

(65) Prior Publication Data

US 2002/0158479 A1 Oct. 31, 2002

(30) Foreign Application Priority Data

Apr. 2, 2001 (DE) ..... 201 05 755 U
Apr. 26, 2001 (DE) ..... 201 07 206 U

(51) Int. Cl.[7] ..... B66C 3/16; E02F 3/413

(52) U.S. Cl. ..... 294/88; 294/68.23; 37/461; 74/424.7; 92/31

(58) Field of Search ..... 294/68.23, 88; 37/186–188, 461; 414/729, 738, 739; 901/22, 37; 92/31, 32, 136, 169.1; 74/424.5, 424.7

(56) References Cited

U.S. PATENT DOCUMENTS 3,255,806 A * 6/1966 Meyer et al. ..... 92/33
3,530,769 A * 9/1970 Mikhailovich ..... 92/33
3,774,954 A * 11/1973 Taguchi et al. ..... 294/68.23
4,409,888 A * 10/1983 Weyer ..... 901/22
4,508,016 A * 4/1985 Weyer ..... 92/33
4,591,199 A * 5/1986 Zajac ..... 294/88
4,654,987 A * 4/1987 Kinshofer ..... 294/68.23
4,897,014 A * 1/1990 Tietze ..... 294/86.4
5,145,313 A * 9/1992 Weyer ..... 74/469
5,447,095 A * 9/1995 Weyer ..... 92/136
6,212,889 B1 * 4/2001 Martin ..... 92/136

FOREIGN PATENT DOCUMENTS

DE 3425035 1/1986
DE 1864451 12/1992
DE 29621601 4/1998
SU 0192384 * 11/1967 ..... 294/68.23
SU 1008140 * 3/1983 ..... 294/68.23

* cited by examiner

*Primary Examiner*—Paul Chin
(74) *Attorney, Agent, or Firm*—Dilworth & Barrese LLP

(57) ABSTRACT

Actuator mechanism for a two-bucket grab device and having two grab arms arranged to move as pincers with respect to one another, has two hydraulic pivot motors with journals of the respective pivot shafts projecting from the motor housing and supporting the grab arms. Each of the pivot motors has a cylindrical tubular piece provided with an internal thread designed to engage an external thread on the respective pivot shaft. The tubular piece is a ring piston axially-displaceably, but non-rotatably held in a cylinder space formed in one of the respective bucket housings. Pitch of the threads is sufficiently large for the ring piston to transmit required torque to the respective pivot shaft by axial displacement of the ring piston. The displacement path of the ring piston between two annular cylinder chambers corresponding to high and low pressure chambers which can be loaded with hydraulic oil, corresponds to the desired pivot angle of the two arms of the grab bucket.

12 Claims, 6 Drawing Sheets

ACTUATOR MECHANISM FOR A TWO-BUCKET GRAB DEVICE

BACKGROUND OF THE INVENTION

The invention relates to a drive apparatus for a grab device comprising two grab arms, which can be moved like pincers, preferably for a two bucket grab, consisting of two hydraulic pivot motors whose shaft journals projecting over the motor housing carry the grab arms.

With known two-bucket grabs, for example, the shafts carrying the buckets are provided with radial levers at which the piston rods or cylinders of hydraulic piston-in-cylinder units are hinged in order to transfer the closing and opening forces onto the shafts. A two-bucket grab known from DE 34 25 035 A1 is characterized by a low construction height in that the hydraulic piston-in-cylinder unit consists of two cylinders which are hinged in each case to the actuating levers of the shafts and whose pistons are connected to one another by a common piston rod. Such two-bucket grabs must be provided with comparatively large hydraulic cylinders because the active lever arms of the actuating levers can change with the pivot angle and can adopt comparatively small active lengths, with the disadvantages additionally existing that the hydraulic cylinders partly cover the grabs which are open to the top and, moreover, represent hazardous components which can be damaged in the operation of the two-bucket grab.

A two-bucket grab of the initially stated kind is known from DE-GM 296 21 601.1 in which the drive for the shafts carrying the buckets is integrated in the bucket carrier. This known two-bucket grab has not components at risk from the material taken up, since the two hydraulic pivot motors are arranged encapsulated in the bucket carrier. In this known two-bucket grab, each pivot shaft of the pivot motors is provided with a plurality of wings forming radial rotary pistons which engage in chambers of a cylinder which are concentric to the shaft axis, with the chambers being separated from one another by a number of radial panels corresponding to the number of rotary pistons and the vertex regions of the rotary pistons sealingly contacting the chamber walls and the vertex regions of the panels contacting the pivot shafts. The hydraulic pivot motors of the known two-bucket grab therefore have a complicated design.

SUMMARY OF THE INVENTION

It is therefore the object of the invention to provide a two-bucket grab of the kind initially stated which is provided with hydraulic pivot motors of a more robust and simple kind.

This object is solved in accordance with the invention in that each of the pivot motors has a cylindrical tube piece which is provided at its inner wall with a section which is provided with an internal thread and which is in engagement with a section of the pivot shaft provided with an external thread; in that the tube piece is a ring piston axially displaceable in but held non-rotatably in a cylinder space formed in one of the housings; in that the pitch of the threads is so large that the ring piston is able to give the pivot shafts the required torque by its axial displacement; and in that the displacement path of the ring piston between the two annular cylinder chambers, which are alternatively high and low pressure chambers which can be loaded with hydraulic oil, corresponds to the desired pivot angles of the two buckets.

The drive of the two-bucket grab in accordance with the invention is characterized by a simple and robust design in that the required pivot movement is only given to the buckets by axial displacement of the ring piston. The rotational security of the ring piston can consist, for example, of a groove which extends axially in the cylinder wall and into which a spigot or wedge connected to the ring piston engages.

The pitch of the threads can be selected such that the torque applied to the pivot shafts by the buckets cannot displace the ring pistons even with pressure-free cylinder chambers due to the friction retaining. If the ring pistons are not moved due to the pressure of the hydraulic oil, the buckets cannot be pivoted due to external forces. This required friction retaining is achieved in that the pitch of the threads is so large that the desired large torque is transferred to the pivot shafts by the axial displacement of the ring pistons.

The thread webs expediently have trapezoidal cross-sections which are characterized by good stability. The drive of the two-bucket grab in accordance with the invention is maintenance-free since the ring piston runs in hydraulic oil.

If two separate pivot motors are provided for the pivot shafts, it can be necessary to provide the two-bucket grab in a conventional manner with synchronisation rods. In accordance with an inventive further development, it is provided that the two ring pistons are connected to one another by a transverse web. This transverse web ensures the synchronous running of the two ring pistons so that conventional synchronisation rods are no longer required.

The bucket carrier preferably consists of two housing halves screwed together of which each is provided with two bearing bores for the one sides of the pivot shafts.

In accordance with a further preferred embodiment, it is provided that the threads of the shafts are located in the region of only one housing half and that in this housing half a first cylinder chamber is formed which corresponds to the peripheral shape of the two ring pistons connected by the web; and in that the peripheral shape is provided with seals sealing this relative to the first cylinder chamber. The peripheral shape can consist of two sides which are parallel to one another and whose ends are connected by semi-circular arcs. The second cylinder chamber can be formed in the other housing half, with the ring pistons projecting over the web in this being provided in the end regions of its bores with ring seals which seal these relative to thread-free sections of the pivot shafts.

The two ring pistons connected to one another by a transverse web do not only provide the desired synchronous running, the active piston areas in these are also enlarged in that they do not only consist of the annular end faces of the ring pistons, but additionally also consist of webs connecting them.

In accordance with a further advantageous aspect, it is provided that the shaft journals of the pivot shafts projecting over the bucket carriers are provided with coupling devices for coupling on the buckets. These can consist, for example, of half-shells which are connected to the buckets, screwed together and are coupled to the shaft journals by bolts which pass through aligned transverse bores of the half-shells and the shaft journals. In this way, a simple fast-exchange system is provided. Buckets of different width can be provided with adapter pieces matched to the shaft journals.

In accordance with a further preferred embodiment, it is provided that plug couplings are arranged on the bucket carriers to make the connections to the hydraulic leads passing through the shaft of a rotary motor and consisting of axial bores. In this embodiment, the shaft of the rotary motor is provided with rotary feedthroughs for the supply and carrying off of hydraulic oil to the pivot motors of the two-bucket grab. The hydraulic leads opening in the end surface of the shaft of the rotary motor coupled with the bucket carrier can be formed as counter pieces to the plug couplings which can be plugged onto hollow spigot shaped counter pieces of the bucket carriers.

BRIEF DESCRIPTION OF THE DRAWINGS

An embodiment of the invention will be explained in more detail in the following with reference to the drawing, in which are shown.

Figure 1:
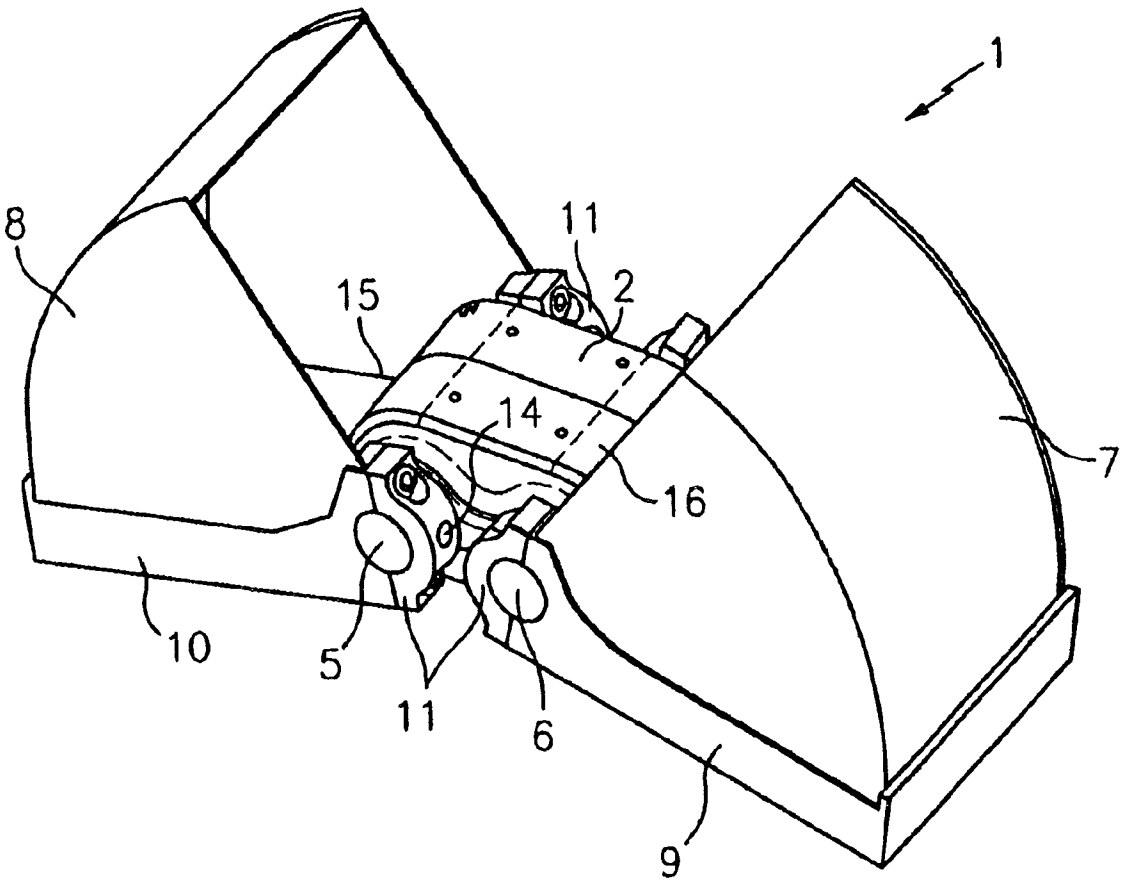
FIG. 1*a* perspective view of the two-bucket grab in accordance with the invention in the open state.
Figure 2:
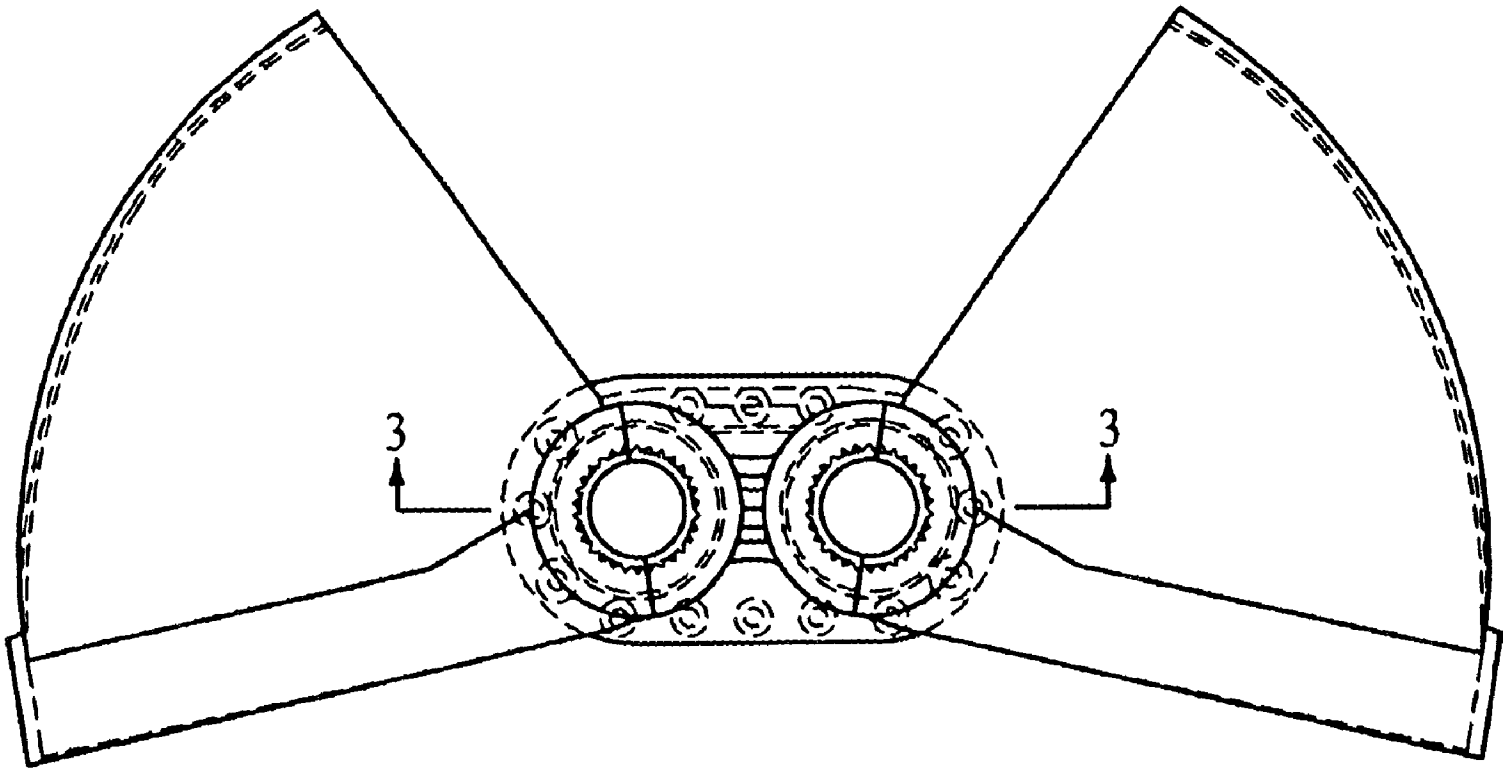
FIG. 2*a* side view of the two-bucket grab in accordance with FIG. 1.
Figure 3:
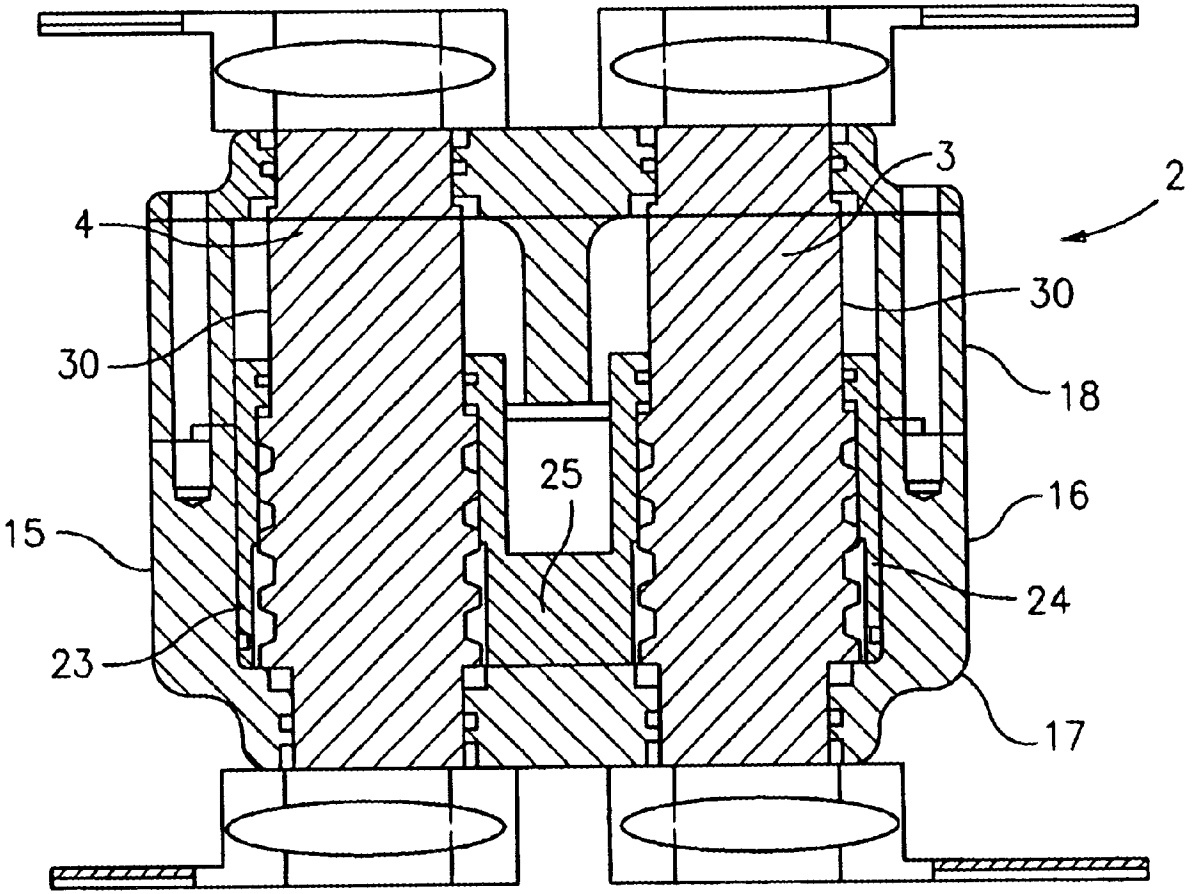
FIG. 3 a section through the two-bucket grab along the line 3—3 in FIG. 2 in an enlarged state.
Figure 4:
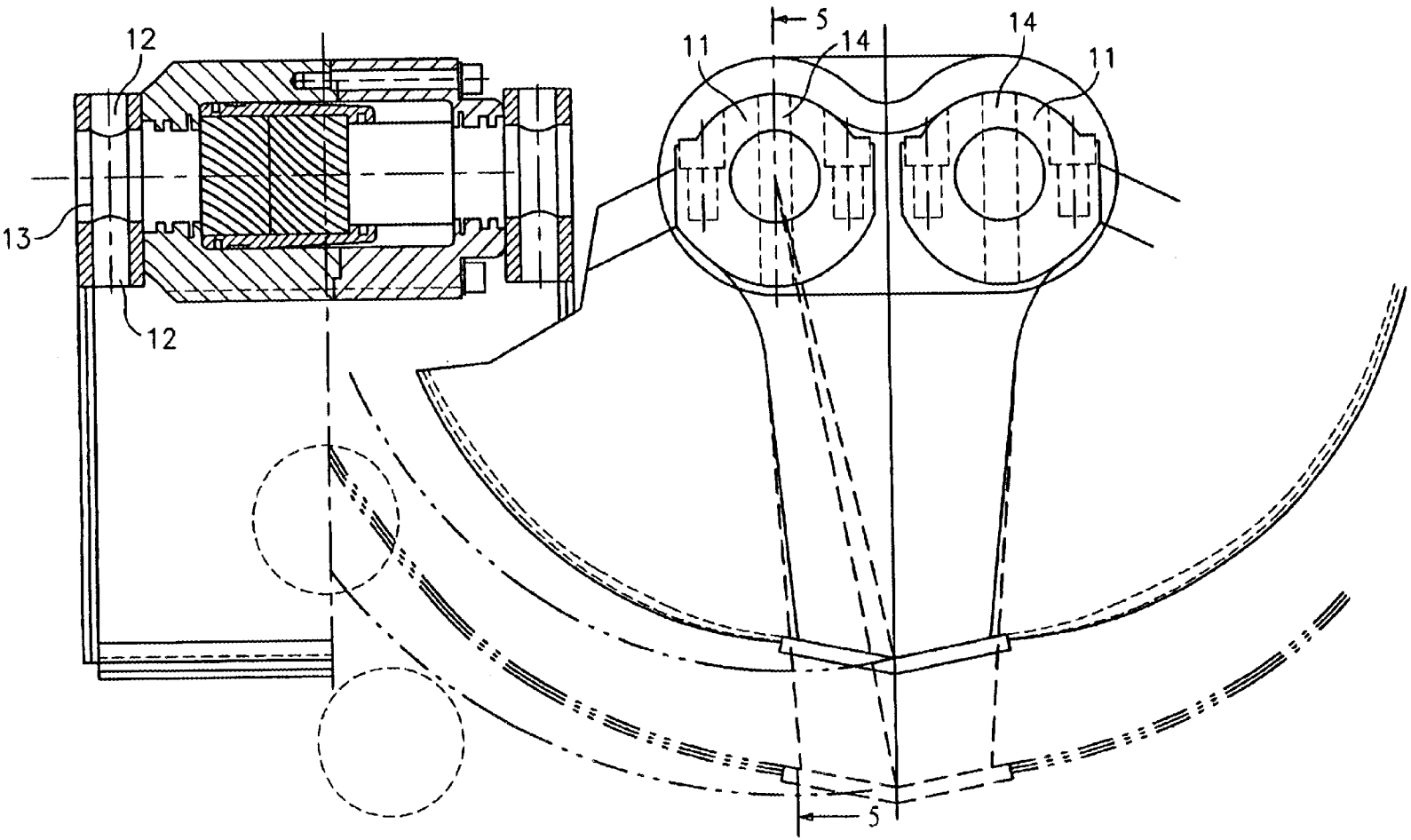
FIG. 4 a side view of the two-bucket grab in the closed state.

The bucket carrier 2 consists of a substantially rectangular housing whose opposite narrow sides 15,16 are rounded in an approximately semi-cylindrical manner. The housing consists of two housing shells 17,18 which are separated roughly at the center and which are screwed together in their separation plane by clamping screws 19. The housing 17,18 is provided on opposite sides with bearing bores in which the pivot shafts 3,4 are mounted. The bores are provided with annular grooves in which ring seals sealing the shaft ends are inserted.

In the region of the housing shell 17, the pivot shafts 3,4 are provided with a threaded section 22. Cylindrical tube pieces 23, 24 are placed on the pivot shafts 3,4 and are provided at their internal wall with a section C having an internal thread which is in engagement with the thread 22 of the pivot shafts 3,4. The cylindrical tube pieces 23, 24 are connected to one another by a web 25. This web 25 is located at an outer side of the cylindrical tube pieces 23, 24 such that these project inwardly beyond the connection web 25. In the region of the connection web 25, the cylindrical tube pieces connected together by this have an outer peripheral shape with a cross-section which consists of two parallel sides which are connected at their narrow sides by arcs with a semi-circular cross-section. The housing shell 17 is provided with an inner peripheral wall whose shape is complementary to the outer shape of the tube pieces 23, 24 connected to one another by the web 25 in the region of the connection web. The tube pieces 23,24 connected together by the connection web 25 are sealed in the region of the connection web by a peripheral seal which is inserted in a groove 28.

The end regions of the sections of the tube pieces 23, 24 projecting over the connection web 25 have at their inner walls ring grooves 30 in which sealing rings are inserted which sealingly connect thread-free sections 31 of the pivot shafts 3, 4.

Cylinder chambers 33, 34 are formed at both sides of the connection web 25 of the tube pieces 23, 24 and are alternately loaded with hydraulic oil at high pressure and connected to low pressure lines to carry off hydraulic oil.

Figure 5:
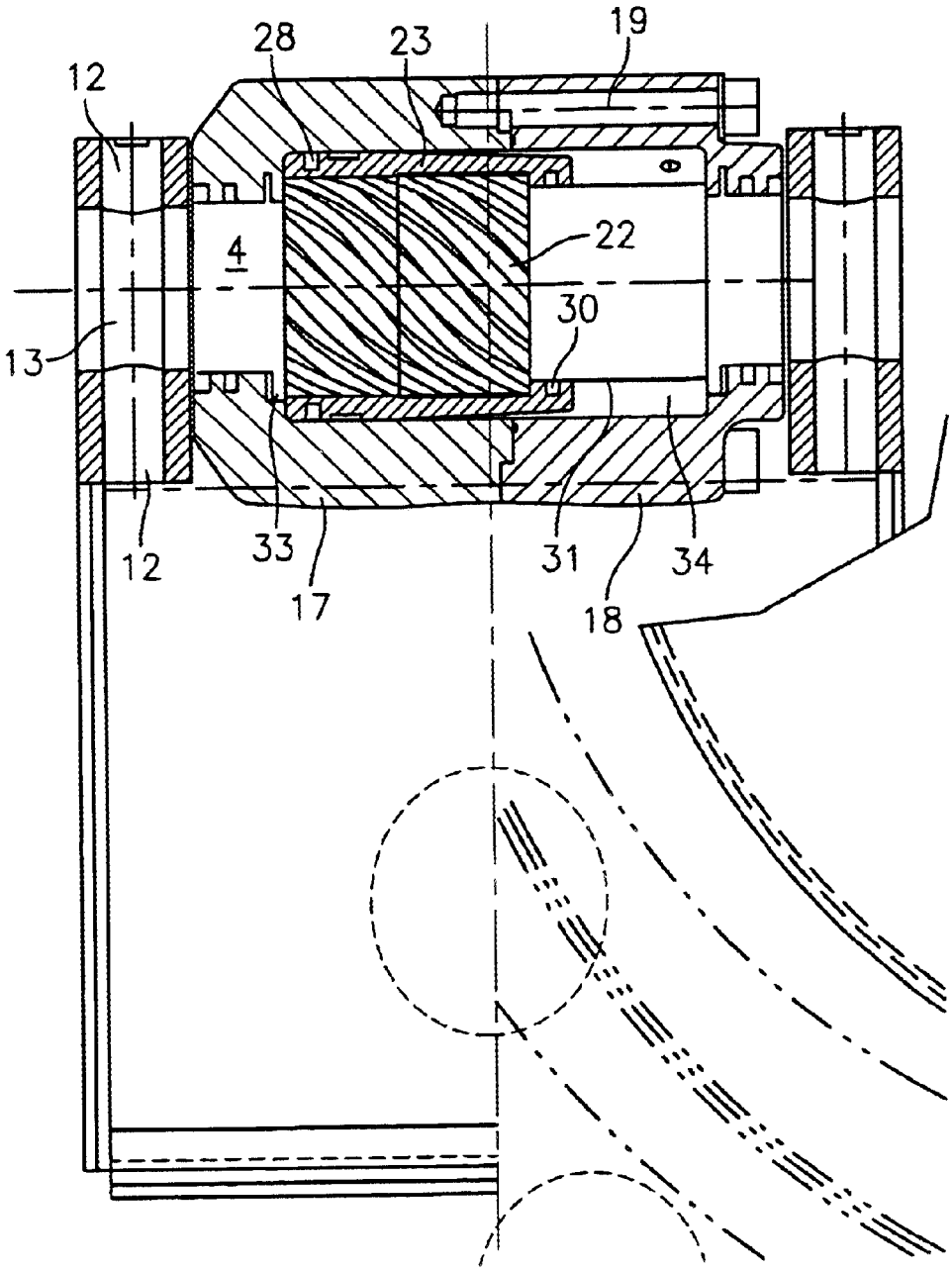
FIG. 5 a section through the two-bucket grab along the line 5—5 in FIG. 4 in an enlarged state.
Figure 6:
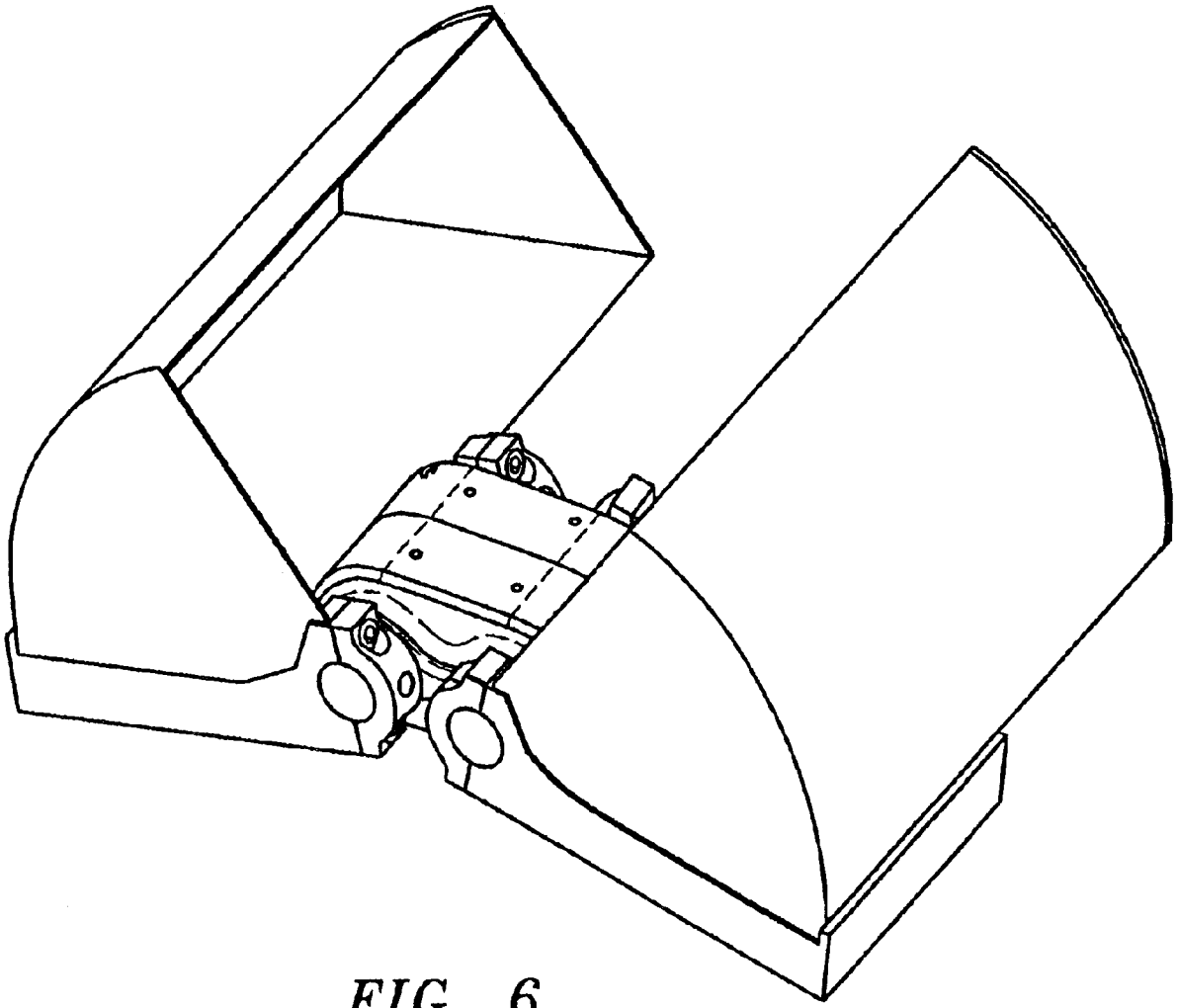
FIG. 6 a perspective view, similar to FIG. 1, and illustrating a two-bucket grab in which the buckets have different width; and The two-bucket grab in accordance with the invention consists of a bucket carrier 2 in which pivot shafts 3, 4 are rotatably mounted whose shaft journals 5, 6 project over both sides of the bucket carrier. The two buckets 7, 8 are coupled with the shaft journals 5, 6. For coupling on, the inner U-shaped, reinforced frame sections 9, 10 of the two buckets have shells at the upper end faces of their limbs which are semi-circular in shape and which encompass the over-projecting shaft journals 5, 6 in that they are screwed together with the side flanges of holding parts 11 which are likewise provided with shell-like recesses with a semi-circular cross-section. The shells, holding parts and shaft journals are provided with aligned bores 12, 13 in which a retaining bolt 14 is inserted.

To pivot the grab buckets 7, 8, the tube pieces 23, 24 connected to one another by the connection web 25 are moved between the end stops of the cylinder chambers 33, 34. In FIG. 5, the tube pieces 23, 24 are located at their left hand end stop. The movement length of the tube pieces 23, 34 up to the right hand end stop corresponds to the section length of the threads 22 on the pivot shafts 3, 4 moved over by the thread section C.

The toothed arrangements 22 and the inner toothed arrangements of the tube pieces 23, 24 consist of thread paths with a trapezoidal cross-section.

The threads have such a pitch that the tube pieces 23, 24 have such a large distance from a friction retaining that they can give the pivot shafts 3, 4 the desired torque. This large thread pitch results, on the other hand, in a friction retaining of the threads if a large force is transferred to these via the grab buckets 7, 8.

The tube pieces 23, 24 can also be made without the connecting transverse web as ring pistons in each case which are then guided in cylindrical cylinder chambers of the bucket carrier. With such an embodiment, however, it is generally necessary to provide compensation rods ensuring a synchronization of the grab buckets.

Thread bores are provided at the upper side of the bucket carrier 2 for the connection of the pivot shaft of a rotary motor.

What is claimed is:

1. Actuator mechanism for a grab device (1) having two grab arms (9, 10) structured and arranged to move as pincers, and comprising two hydraulic pivot motors respectively having pivot shafts (3, 4) and shaft journals (5, 6) therefor and projecting from a carrier housing (2) to support the respective grab arms (9, 10), wherein each of said pivot motors comprises a tubular piece (23, 24) in turn provided with an internally-threaded section structured and arranged to engage an externally-threaded section upon a respective pivot shaft (3, 4), said tubular pieces (23, 24) are each formed as a ring piston axially-dispaceably, but non-rotatably retained in a respective cylinder space (33, 34) formed in said carrier housing (2), pitch of the respective internally and externally-threaded sections is sufficiently large to transmit required torque to said pivot shafts (3, 4) by axial displacement of said ring pistons (23, 24), a displacement path of each said ring piston (23, 24) between two annularly-arranged cylinder chambers (33, 34) in each said cylinder space (33, 34) alternatively constituting high and low pressure chambers (33, 34) which can be loaded with hydraulic oil, corresponds to required pivot angle of the two grab arms (9, 10), and additionally comprising a transverse web (25) interconnecting said two ring pistons (23, 24) to ensure synchronous operation of the same.

2. The combination of claim 1, additionally comprising two buckets (7, 8), each arranged upon a respective arm (9, 10) of said device (1), and the displacement path corresponds to a required pivot angle of the buckets (7, 8).

3. The combination of claim 2, wherein said shaft journals (5, 6) projecting from said housing (2) additionally comprise means for coupling to said buckets (7, 8).

4. The combination of claim 3, wherein said buckets (7, 8) differ in width and are provided with adapter pieces matched to said shaft journals (5, 6).

5. The combination of claim 1, wherein the pitch is sufficiently large to prevent torque applied to said pivot shafts (3, 4) by load from displacing said ring pistons (23, 24) even with pressure-free cylinder chambers (33, 34), due to frictional retention.

6. The combination of claim 1, wherein webs forming the threads have trapezoidal cross-sections.

7. The combination of claim 1, wherein said carrier housing (2) comprises two halves (17, 18) screwed (19) together, with each said half (17, 18) provided with bearing bores in which said respective pivot shafts (3, 4) are mounted.

8. The combination of claim 1, wherein said shaft journals (5, 6) projecting from said housing (2) additionally comprise means for coupling to said grab arms (9, 10).

9. The combination of claim 1, additionally comprising plug couplings arranged upon said housing (2) for allowing connection to hydraulic leads passing through a shaft of the respective rotary motor and constituted by axial bores.

10. Actuator mechanism for a grab device (1) having two grab arms (9, 10) structured and arranged to move as pincers, and comprising two hydraulic pivot motors respectively having pivot shafts (3,4) and shaft journals (5,6) therefor and projecting from a carrier housing (2) to support the respective grab arms (9, 10), wherein each of said pivot motors comprises a tubular piece (23, 24) in turn provided with an internally-threaded section structured and arranged to engage an externally-threaded section upon a respective pivot shaft (3, 4), said tubular pieces (23, 24) are each formed as a ring piston axially-displaceably, but non-rotatably retained in a cylinder space (33, 34) formed in said carrier housing (2), pitch of the respective internally and externally-threaded sections is sufficiently large to transmit required torque to said pivot shafts (3,4) by axial displacement of said ring pistons (23, 24), a displacement path of each said ring piston (23, 24) between two annularly-arranged cylinder chambers (33, 34) in each said cylinder space (33, 34) alternatively constituting high and low pressure chambers (33, 34) which can be loaded with hydraulic oil, corresponds to required pivot angle of the two grab arms (9, 10), a transverse web (25) interconnects said two ring pistons (23, 24) to ensure synchronous operation of the same, and the threads of each said respective shaft (3, 4) are located in a region of only one half (17, 18) of said carrier housing (2) containing said cylinder space or chamber (33, 34) corresponding to a peripheral shape of said two ring pistons (23, 24) connected by said web (25).

11. The combination of claim 10, wherein the peripheral shape is constituted by two substantially-parallel sides interconnecting by semi-circular arcs.

12. Actuator mechanism for a grab device (1) having two grab arms (9, 10) structured and arranged to move as pincers, and comprising two hydraulic pivot motors respectively having pivot shafts (3,4) and shaft journals (5,6) therefor and projecting from a carrier housing (2) to support the respective grab arms (9, 10), wherein each of said pivot motors comprises a tubular piece (23, 24) in turn provided with an internally-threaded section structured and arranged to engage an externally-threaded section upon a respective pivot shaft (3, 4), said tubular pieces (23, 24) are each formed as a ring piston axially-displaceably, but non-rotatably retained in a respective cylinder space (33, 34) formed in said carrier housing (2), pitch of the respective internally and externally-threaded section is sufficiently large to transmit required torque to said pivot shafts (3, 4) by axial displacement of said ring pistons (23, 24), a displacement path of each said ring piston between two annularly-arranged cylinder chambers (33, 34) in each said cylinder space (33, 34) alternatively constituting high and low pressure chambers (33, 34) which can be loaded with hydraulic oil, corresponds to required pivot angle of the two grab arms (9, 10), additionally comprising a transverse web (25) interconnecting said two ring pistons (23, 24) to ensure synchronous operation of the same, and said carrier housing (2) comprising two halves (17, 18), with a respective cylinder chamber (33, 34) formed in each said half (17, 18) for receiving a respective one of said pieces (23, 24).

* * * * *